US005615502A

United States Patent [19]

Gabrius

[11] Patent Number: 5,615,502

[45] Date of Patent: Apr. 1, 1997

[54] PLATE CLOSURE FOR USE IN INTERNALLY ILLUMINATED SIGN

[75] Inventor: Algimantas J. Gabrius, Carol Stream, Ill.

[73] Assignee: Juno Lighting, Inc., Des Plaines, Ill.

[21] Appl. No.: 558,146

[22] Filed: Nov. 15, 1995

[51] Int. Cl.[6] ..... G09F 13/04

[52] U.S. Cl. ..... 40/570; 40/564; 40/574

[58] Field of Search ..... 40/570, 541, 564, 40/568, 572, 574, 617, 757; 362/812, 362

[56] References Cited

U.S. PATENT DOCUMENTS 5,018,290 5/1991 Kozek et al. ..... 40/570

FOREIGN PATENT DOCUMENTS 2047830 4/1992 Canada ..... 40/570

*Primary Examiner*—Kenneth J. Dorner
*Assistant Examiner*—Cassandra Davis
*Attorney, Agent, or Firm*—Anthony S. Zummer

[57] ABSTRACT

A plate closure for use in an internally illuminated sign having a plurality of wiring ports to provide access to the interior of the sign for connecting wires from a power source including a housing made up of a pair of interlockable halves. Each of the halves has a peripheral sealing lip opposed to the peripheral lip of the other half to form a peripheral housing wall. The housing wall has a pair of substantially parallel opposed end walls, a top housing wall and a bottom wall. A top wiring port is formed in the top wall. A left wiring port is formed in one of the end walls, and a right wiring port is formed in the other of the end walls. Each of the wiring ports provides a selective access to the interior of the housing to provide wiring for a light source. Each of the walls, having one of the wiring ports, has a mounting groove in a portion of the housing wall defining the wiring port. Each mounting groove extends into the respective wall and opens into the respective wiring port. A closure plate is removably mounted in each of selected wiring ports. Each closure plate has a flat plate body. Each plate body has a mounting tongue. Each mounting tongue has a protuberance on the surface thereof to provide an interference fit with a portion of a respective mounting groove to hold releasably the closure plate in the mounting groove.

11 Claims, 3 Drawing Sheets

PLATE CLOSURE FOR USE IN INTERNALLY ILLUMINATED SIGN

BACKGROUND OF THE INVENTION

Internally illuminated signs are customarily required by fire and building codes of various governmental agencies to identify an exit from a given area or to identify a direction to an exit. Such internally illuminated signs often include a housing with a stencil which has the letters forming the word "EXIT" cut into a stencil as a message. A directional indicating arrow is cut into the stencil at each end of the word "EXIT". The sign includes an illumination source internally of the housing to provide the requisite illumination for the message.

Each sign is typically mounted on a structure. A given sign may be mounted from a ceiling or supporting structure wherein the top of the sign is connected to the supporting structure. Accordingly, wiring to the interior of the sign and to light source enters the housing through a top wiring port. The sign may be mounted on a vertical wall so that one end of the sign is attached to the vertical wall and wiring to the interior of the sign and to light source enters the housing through a wiring port in an end wall of the sign. The sign may also be mounted with an opposite end against a vertical wall so that the wiring enters the housing through a wiring port in the other end of the housing.

In order to make a sign adaptable for mounting as a top mounted or a right or left mounted sign, the sign manufacturer typically provides wiring ports on the top and two opposed ends of the sign. It is desirable to provide a plate closure for the wiring ports which are not in use to close off the interior of the housing.

A manufacturer typically provides removably closure plates for wiring apertures which are not in use. One of the problems encountered in the field by workmen is that the closure plates are difficult to handle. Therefore, it is particularly desirable to provide an improved removable closure plate for a wiring port, which closure plate may be handled with facility in the field.

SUMMARY OF THE INVENTION

The present invention is an improved construction for an internally illuminated sign having a plurality of wiring ports, and in particular, an improved removable closure plate which facilitates closing of a wiring port and assembly of a housing with the closure plate in position in a wiring port. The sign includes a housing having a pair of interlockable four sided housing halves. A stencil is a part of one of the housing halves. The stencil is generally rectangular in outline and has a plurality of openings formed therein which openings form a message. A light source is mounted in the housing to illuminate the openings. A diffuser is mounted on the stencil between the light source and the stencil to color the illumination to the openings.

Each housing half has a peripheral sealing lip engagable with an opposed peripheral sealing lip to form a peripheral housing wall. The housing wall has a pair of parallel opposed end walls and a top wall substantially perpendicular to the opposed end walls. A bottom wall parallel to the top wall is connected to the end walls. Wiring ports are formed in the top wall and each of the end walls to provide selective access to the interior of the housing for conventional wiring to the light source. Each of the walls having one of the wiring ports has a mounting groove in a portion of the wall defining the wiring port. Each mounting groove extends into the respective wall and opens into the respective wiring port.

A closure plate is removably mounted in each of the wiring ports. Each closure plate has a flat plate body having a mounting tongue formed integral with the periphery of the plate body. Each of the mounting tongues is removably positioned in the respective mounting groove. A protuberance on each mounting tongue provides an interference fit in a portion of the respective mounting groove to hold releasably the closure plate in the respective wiring port on one of the housing halves and the remainder of the tongue in the mounting groove in the other housing half is relatively free for removal from the other housing half.

DETAILED DESCRIPTION

Figure 1:
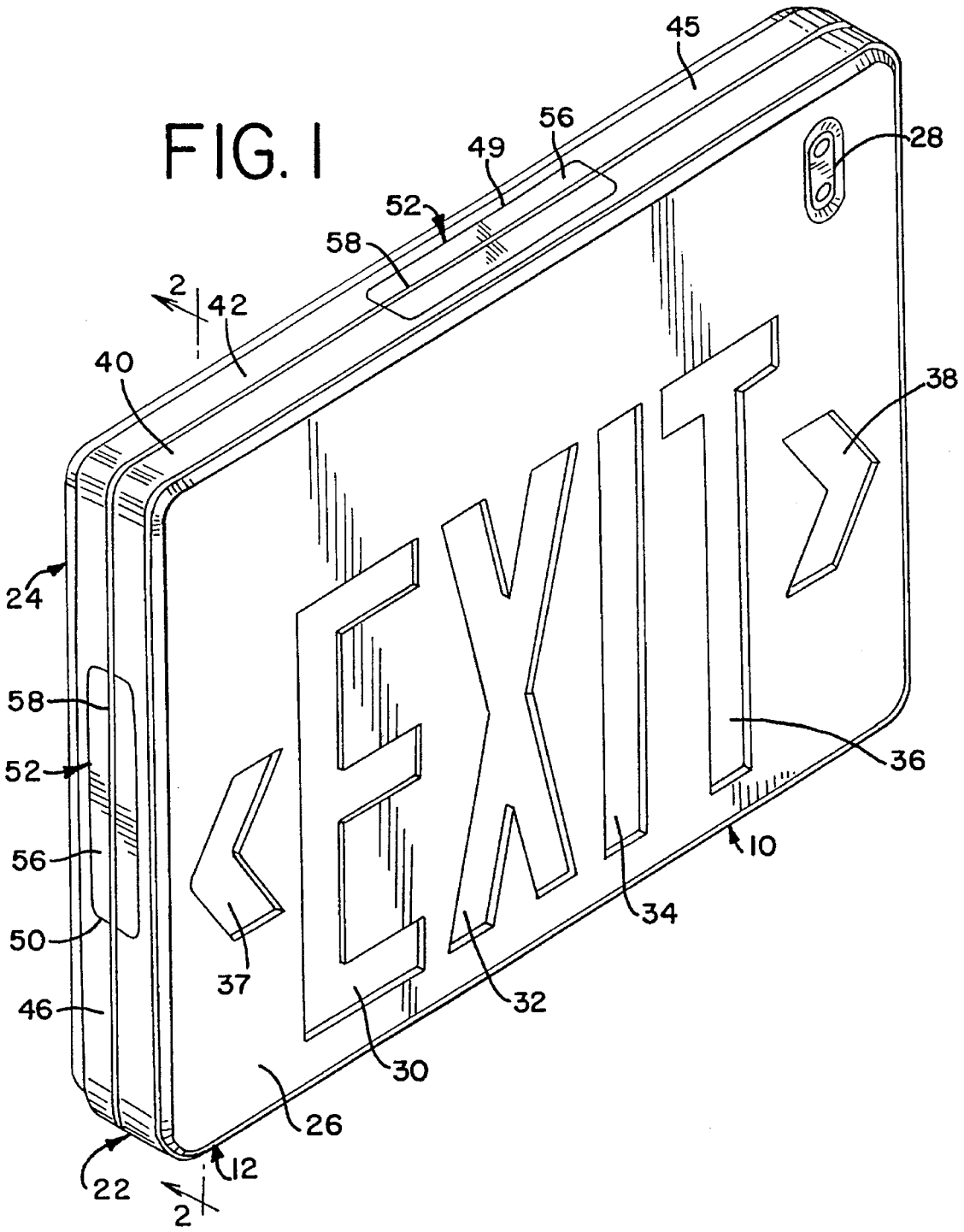
FIG. 1 is a perspective view of an internally illuminated sign embodying the instant invention.
Figure 3:
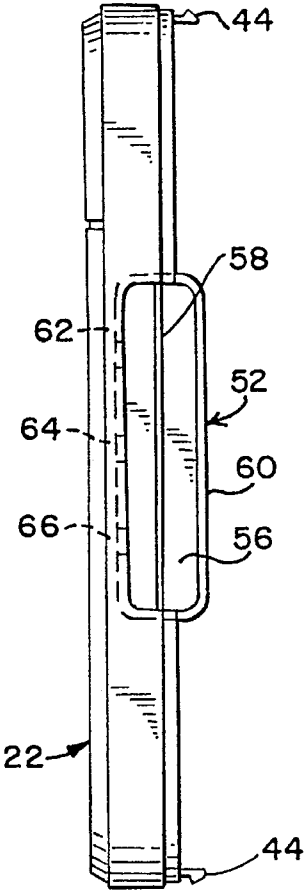
FIG. 3 is an end elevational view of the internally illuminated sign of FIG. 1 with one housing half removed showing a closure plate mounted in a portion of a wiring port.
Figure 2:
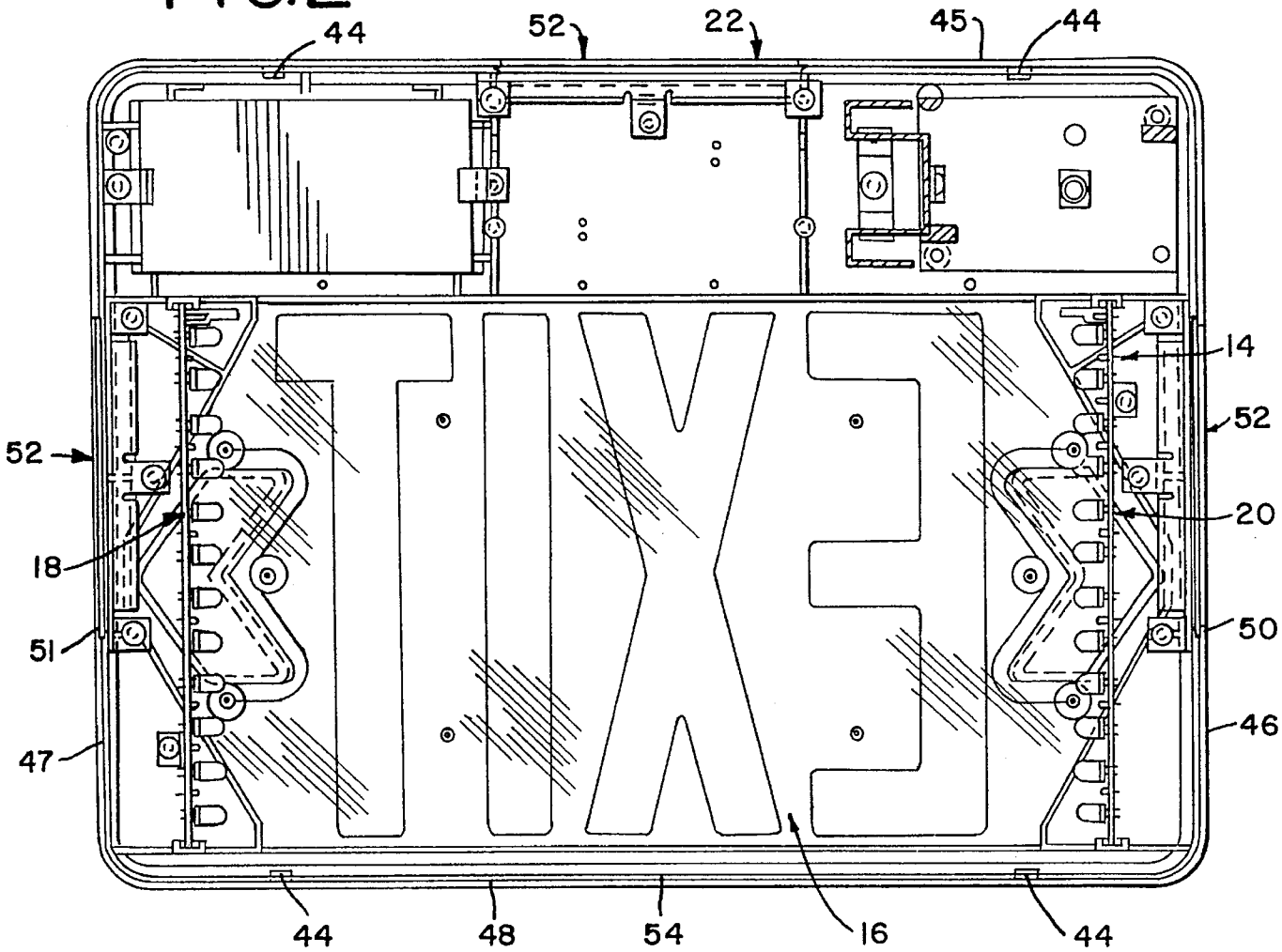
FIG. 2 is a cross sectional view through the internally illuminated sign of FIG. 1 showing a portion of the housing with a translucent sheet diffuser mounted therein and a light source assembly mounted in the housing.

Referring now to the drawings, and especially to FIGS. 1 and 2, an internally illuminated sign generally indicated by numeral 10 is shown therein and is a specific embodiment of the present invention. Sign 10 generally includes a housing 12 with a conventional light source assembly 14 mounted in the housing. A translucent sheet diffuser 16 is mounted on an interior surface of the housing. The light source assembly is conventional, in that, it includes a converter and a storage unit which are electrically connected to a first series of conventional illuminating lamps 18 and a second series of conventional illuminating lamps 20.

Housing 12 includes a pair of mateable generally rectangular housing halves 22 and 24. Housing half 22 includes a substantially flat rectangular stencil 26. A conventional switch and test assembly 28 is mounted in one corner of stencil 26. As is conventional, switch assembly 28 is connected to light source assembly 14. The stencil has four separate letter openings 30, 32, 34 and 36 formed therein, which letter openings spell out the message "EXIT". The stencil includes a first directional indicating arrow opening 37 adjacent to letter opening 30 and a second directional indicating arrow opening 38 adjacent to letter opening 36. The two arrow openings indicate directions away from each other and away from the message.

Housing half 22 includes a closure lip 40 formed integral with the other periphery of the stencil and extends around the entire periphery of the stencil. Housing half 24 has a closure lip 42 which is mateable with closure lip 40. Closure lips 40 and 42 make up the outer wall of the housing. Closure lip 42 has four identical resilient fingers 44 formed therein which are mateably received in lock openings in closure lip 42, as is conventional, in order to hold the housing halves together to complete the housing.

The housing outer wall has a top wall 45. A left end wall 46 and a right end wall 47 are parallel to each other and are formed integral with opposed ends of the top wall. A bottom wall 48 parallel to the top wall has its opposed ends integral with the left and right end walls. A top wiring port 49 is formed in top wall 45. Top wiring port 49 is elongated and is parallel to the adjacent edge of stencil 26. A left wiring port 50 is formed in left end wall 46 at one end of the housing, and a right wiring port 51 is formed in right end wall 47 at the other end of the housing. Wiring ports 50 and 51 are identical to each other and to port 49. Each of the wiring ports has a portion formed in closure lip 40 and the remainder in closure lip 42. Ports 50 and 51 are parallel to adjacent edges of stencil 26. Each wiring port provides access to the interior of the housing to allow wiring to be connected to the light source assembly to provide a conduit to a conventional source of electrical energy. Each of the wiring ports is of the same size and shape so that an identical closure plate 52 is used to close each wiring port. Each wiring port has a continuous mounting groove 54 formed into the outer wall of the housing to receive a portion of a closure plate positioned in the wiring port. Mounting groove 54 of each wiring port extends uniformly into closure lip 40 and closure lip 42 to provide a continuous groove in the periphery of the respective wiring port.

Figure 4:
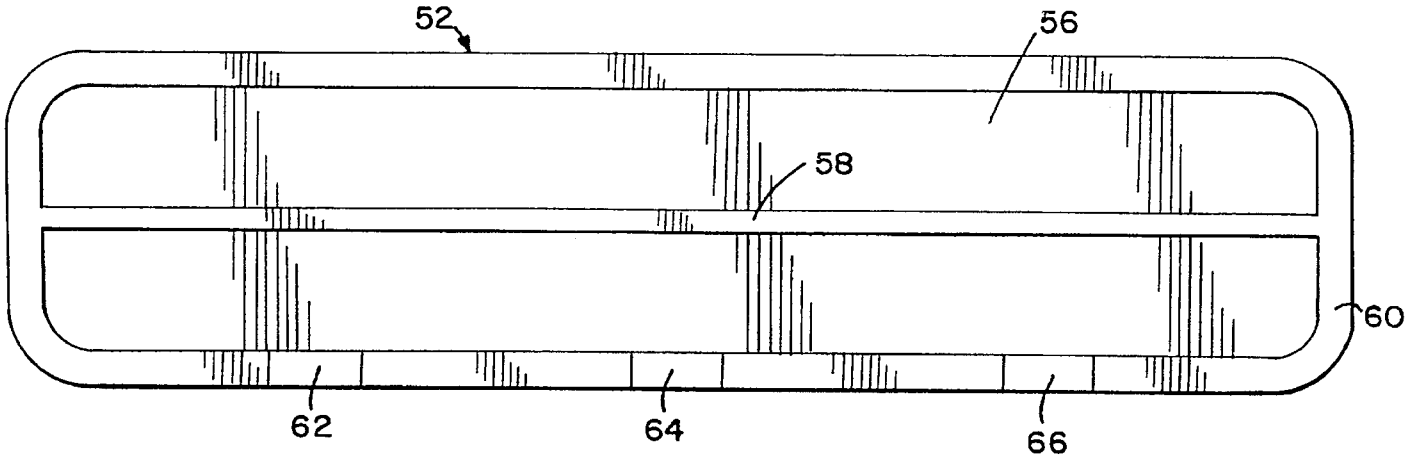
FIG. 4 is an enlarged plan view of the closure plate shown in FIG. 3.
Figure 5:
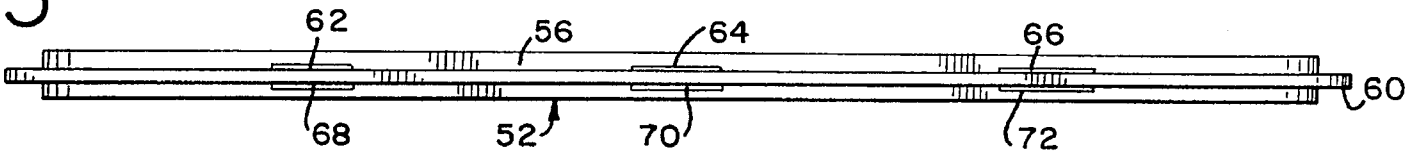
FIG. 5 is a bottom view of the closure plate of FIG. 4 showing six protuberances on a mounting tongue of the closure plate.
Figure 7:
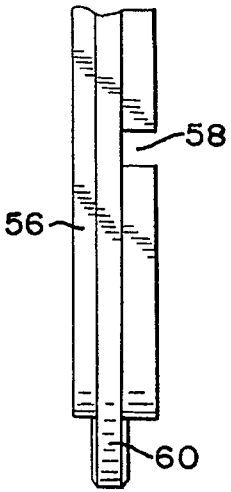
FIG. 7 is an enlarged fragmentary end view of a portion of the closure plate of FIG. 4.

Closure plate 52 includes a flat body 56 which has an outline that fits into any one of the identical wiring ports. The flat body has a groove 58 on one side to be an extension of and aligned with a groove formed between the housing halves. A flat mounting tongue 60 is formed parallel to and integral with the flat body and extends around the entire periphery of the flat body. The mounting tongue extends outward from the body and is positioned in the mounting groove. The flat mounting tongue has protuberances 62, 64, 66, 68, 70 and 72 integrally formed thereon all adjacent to the same side of the body, as best seen in FIGS. 4 and 5. All of the protuberances are positioned in a mounting groove in a single housing half. Protuberances 62 and 68 are oppositely positioned on the mounting tongue and spaced from protuberances 64 and 70 which are oppositely positioned on the mounting tongue. Protuberances 66 and 72 are oppositely positioned on the mounting tongue and are spaced from protuberances 64 and 70 the same distance that protuberances 62 and 68 are spaced from protuberances 64 and 70. Each of the protuberances extends from the flat body to the end of the tongue. Each protuberance has a thickness of approximately 0.004 inches (0.010 centimeters).

Figure 6:
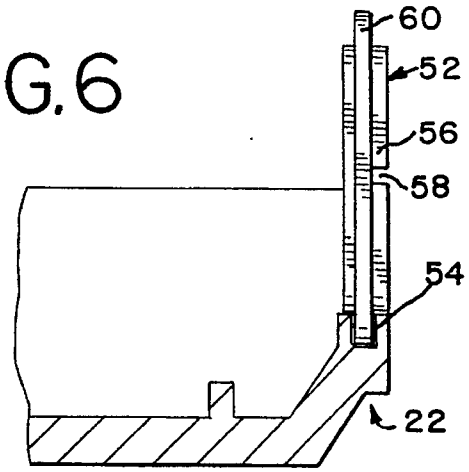
FIG. 6 is an enlarged cross sectional view through a portion of a housing half showing an end view of the closure plate of FIG. 3 mounted in a mounting groove of a housing half.

Each of the closure plates is mounted in a respective wiring port. The protuberances on the mounting tongue create an interference fit between the mounting tongue and the mounting groove in the respective portion of the outer wall, as may be best seen in FIG. 6. Thus, the closure plate is held in place in one housing half even though the halves of the housing are separated. In view of the fact that there is an interference fit at the protuberances, the closure plate may be easily removed to open a wiring port. When the housing halves are put back together, the port which had the closure plate removed is open and the other ports are closed by their respective closure plates. The housing is readily reassembled in view of the fact that the closure plates left in the housing are held in one of the housing halves with an interference fit but are readily reengaged in the mounting groove in the mating housing half.

The manufacturer of the internally illuminated sign ships the signs with closure plates in two of the wiring ports. When it is established that wiring should enter the housing through one of the wiring ports, it is a simple matter for the workman to separate the housing halves for connection of the wiring to the light source assembly. In the event that a given wiring port is utilized which has a closure plate in place, the closure plate for that port is removed and inserted into the wiring port which did not have a closure plate in place. Once the wires are appropriately connected to the light source assembly, the two housing halves are reassembled with a minimum of difficulty in view of the fact that the closure plates in the respective wiring ports are held in position in one of the housing halves through the interference fit with the mounting groove, and the other housing half is readily positioned to receive the balance of the mounting tongue.

Although specific sizes and positions of various parts of the present internally illuminated sign have been set forth in detail above, it is readily apparent that those skilled in the art may make various modifications and changes without departing from the spirit and scope of the present invention. It is to be expressly understood that the present invention is limited only by the appended claims.

What is claimed is:

1. An internally illuminated sign including; a housing, said housing having a pair of opposed housing halves, each of said housing halves having a rectangular outline, one of said housing halves having a stencil with four edges defining a rectangle, said stencil having a plurality of openings forming a message, a light source mounted in the housing, a diffuser positioned between the light source and the stencil, each housing half having a peripheral sealing lip engagable with one another to form a peripheral housing wall, said housing wall having a pair of substantially parallel opposed end walls, a top housing wall substantially perpendicular to the opposed end walls, and a bottom wall substantially parallel to the top wall; a top wiring port in the top wall, a left wiring port in one of the end walls, and a right wiring port in the other of the end walls, each of said wiring ports providing selective access to the interior of the housing for a conduit to a source of electrical energy to the light source, each of said wiring ports having a mounting groove in a portion of the wall defining the respective wiring port, each mounting groove extending into the respective wall and opening into the respective wiring port, and a closure plate removably mounted in each of selected wiring ports, each closure plate having a flat plate body, each plate body having a mounting tongue formed integral with the plate body, each mounting tongue removably positioned in a respective mounting groove, each mounting tongue having a first protuberance on one surface thereof and on one side edge of the plate body providing an interference fit in a portion of the respective mounting groove to hold releasably the closure plate in the respective wiring port in the wall of one of the housing halves and the remainder of the tongue in the mounting groove in the other housing half is relatively free allowing free disengagement of the closure plate from the other housing half.

2. An internally illuminated sign as defined in claim 1, wherein each protuberance extends from the plate body to an end of the tongue.

3. An internally illuminated sign as defined in claim 1, wherein each wiring port is elongated in a direction substantially parallel to an adjacent edge of the stencil, each closure plate body is substantially the same size as the wiring port, and a plurality of the protuberances on each mounting tongue on one side edge of the plate body for an interference fit with the respective portion of the respective mounting groove.

4. An internally illuminated sign as defined in claim 1, wherein a second protuberance is positioned on the mounting tongue adjacent to one side the first protuberance, and a third protuberance is positioned on the mounting tongue adjacent to and on the other side of the first protuberance, the distance between the first protuberance and the second protuberance is substantially equal to the distance between the second protuberance and the third protuberance.

5. An internally illuminated sign as defined in claim 1, including a second protuberance on the mounting tongue on an opposite surface of the mounting tongue opposite the first protuberance.

6. An internally illuminated sign as defined in claim 1, wherein each wiring port is elongated substantially parallel to a respective adjacent edge of the stencil, the body of each closure plate being substantially the same size as each of the wiring port, a plurality of protuberances on the mounting tongue on the side edge of the plate body as the first protuberance for an interference fit with the respective portion of the respective mounting groove, each of the protuberances extending from the plate body to an end of the tongue.

7. An internally illuminated sign as defined in claim 1, including, a second protuberance on the one surface of the mounting tongue spaced from the first protuberance, and a third protuberance on the one surface of the mounting tongue spaced from the first protuberance a distance equal to the distance between the second protuberance and the first protuberance, each protuberance extending from the plate body to an end of the tongue.

8. An internally illuminated sign as defined in claim 1, including, a second protuberance on the mounting tongue on an opposite surface of the mounting tongue opposite the first mentioned protuberance, each protuberance extending from the plate body to an end of the tongue.

9. An internally illuminated sign as defined in claim 1, wherein each wiring port is elongated in a direction substantially parallel to the respective adjacent side of the stencil, each plate body having substantially the same size as the respective wiring port, a plurality of the protuberances on the one surface of the mounting tongue with the first protuberance and on the side edge of the plate body as the first protuberance for an interference fit with the respective mounting groove, a second plurality of protuberances on an opposite surface of the mounting tongue on the side edge of the plate body as the first protuberance.

10. An internally illuminated sign as defined in claim 1, wherein each wiring port is elongated in a direction substantially parallel to the respective adjacent side of the stencil, each plate body is substantially the same size as the wiring port, a second protuberance on the one surface of the mounting tongue and the side edge of the elongated body as the first mentioned protuberance, a third and a fourth protuberance spaced from each other and on an opposite surface of the mounting tongue and on the same side of the body as the first protuberance, each protuberance extending from the plate body to an end of the tongue.

11. An internally illuminated sign as defined in claim 1, wherein each wiring port is elongated in a direction substantially parallel to the respective adjacent side of the stencil, each plate body being substantially the same size as each wiring port and being positionable in a respective wiring port to close the port, a second protuberance spaced from the first protuberance on the one surface of the mounting tongue and the plate body as the first protuberance, a third protuberance spaced from the first protuberance on the one surface of the mounting tongue and on the side edge of the plate body as the first protuberance, said third protuberance being spaced from the first protuberance the same distance as the distance between the first protuberance and the second protuberance, three additional protuberances on a second surface of the mounting tongue opposite to the first protuberance, each of the three additional protuberances being positioned in opposition to each of first, second, and third protuberances being positioned on the one surface of the mounting tongue, each of the protuberances formed integral with the mounting tongue and extending from the plate body to an end of the mounting tongue.

* * * * *